US005561866A

United States Patent [19]

Ross

[11] Patent Number: 5,561,866

[45] Date of Patent: Oct. 8, 1996

[54] SAFETY HELMETS

[75] Inventor: Leslie Ross, 2 Wellesley Close Avendale, Ashe Vale, Surrey GU1255W, Great Britain

[73] Assignees: Leslie Ross, Surrey; Christopher Andrew Brine, Farnborough, both of Great Britain

[21] Appl. No.: 360,777

[22] PCT Filed: Jun. 28, 1993

[86] PCT No.: PCT/GB93/01349

§ 371 Date: Feb. 28, 1995

§ 102(e) Date: Feb. 28, 1995

[87] PCT Pub. No.: WO94/00031

PCT Pub. Date: Jan. 6, 1994

[30] Foreign Application Priority Data

Jun. 27, 1992 [GB] United Kingdom ..... 9213704

[51] Int. Cl.[6] ..... A42B 3/00

[52] U.S. Cl. ..... 2/410; 2/412; D29/102

[58] Field of Search ..... 2/410, 411, 412, 2/414, 424, 425, 205, 195.5, 200.3, 173.5; D29/102, 103, 104, 105, 106, 108

[56] References Cited

U.S. PATENT DOCUMENTS

| | | | |
|---|---|---|---|
| D. 205,652 | 9/1966 | Brockway | D29/104 |
| 824,274 | 6/1906 | Banks | 2/200.3 |
| 1,772,740 | 8/1930 | Anderson | 2/200.3 |
| 3,447,163 | 6/1969 | Bothwell | 2/421 |
| 4,075,717 | 2/1978 | Lemelson . | |
| 4,288,268 | 9/1981 | Hartung | 2/411 |
| 4,564,959 | 1/1986 | Zahn | 2/411 |

FOREIGN PATENT DOCUMENTS

| | | | |
|---|---|---|---|
| 2034450 | 7/1992 | Canada | 2/411 |
| 90720 | 10/1983 | European Pat. Off. | 2/411 |
| 127811 | 12/1984 | European Pat. Off. . | |
| 2335169 | 8/1977 | France | 2/412 |
| 2346992 | 12/1977 | France | 2/414 |
| 2370448 | 7/1978 | France | 2/412 |
| 2561877 | 10/1985 | France . | |
| 2566632 | 1/1986 | France | 2/412 |
| 487643 | 6/1938 | United Kingdom . | |
| 717121 | 10/1954 | United Kingdom . | |
| 2196833 | 5/1988 | United Kingdom | 2/411 |

*Primary Examiner*—Michael A. Neas
*Attorney, Agent, or Firm*—Lowe, Price, LeBlanc & Becker

[57] ABSTRACT

A safety helmet for e.g. motorcycles has its outer shell firmed as a sandwich, comprising outer and inner composite layers each of resin and impact-resistant material separated by an intermediate layer of resilient material. The impact-resistant material is preferably a cloth of high tensile strength fiber such as KEVLAR™, DYNEMA™, glass fiber, or carbon fiber. The resilient material may be cork or foamed or other resilient plastics material, but is preferably honeycomb material of paper or aluminum. The helmet is made by sequentially laying up, in or over a former, a first composite layer of resin and sheets of impact-resistant material, an intermediate layer of honeycomb material, and a second composite layer of resin and sheets of impact-resistant material. The outer shell has a polyhedral form including a plurality of polygonal faces having abutting edges.

17 Claims, 1 Drawing Sheet

SAFETY HELMETS

The present invention relates to safety helmets, and particularly but not exclusively crash helmets for motorcyclists.

The general requirements for a safety helmet are that it should have a strong and shatterproof outer shell and an inner support or lining which spreads and cushions any sharp blow to the shell. A motorcycle crash helmet also has various special requirements, such as that it should protect the face and the back and sides of the user's head as well as the top of the skull, that it should not come off in an accident, that it should resist penetration by sharp objects, and that it should have a transparent visor.

The standard construction of crash helmet consists of a substantially spheroidal outer shell of tough plastics material, which may be made by injection moulding, wet laying up, or a similar process, and an inner lining of resilient material. The outer shell may be a glass fibre or KEVLAR™ laminate, and the inner lining may be a foam material. When such a helmet is struck, the energy is dissipated and absorbed primarily by the inner lining; the outer shell is essentially rigid, and serves primarily to transmit and spread the load to the inner lining.

The main object of the present invention is to provide an improved crash helmet, though the invention extends to safety helmets generally.

Accordingly the invention provides a safety helmet comprising an outer shell formed as a sandwich, comprising outer and inner composite layers each of resin and impact-resistant material separated by an intermediate layer of resilient material, characterized in that it is of generally polyhedral form comprising a plurality of polygonal faces, preferably approximately in the form of part of a truncated icosahedron.

The outer shell may be formed as a sandwich, comprising outer and inner composite layers each of resin and impact-resistant material separated by an intermediate layer of resilient material. The impact-resistant material may be a cloth of KEVLAR™, DYNEMA™, glass fibre, or carbon fibre. The resilient material may be cork or foamed or other resilient plastics material, but is preferably honeycomb material of paper or aluminium.

The invention also provides a manner of constructing such a safety helmet, comprising sequentially laying up, in or over a former, a first composite layer of resin and sheets of impact-resistant material, an intermediate layer of honeycomb material, and a second composite layer of resin and sheets of impact-resistant material.

Figure 1:
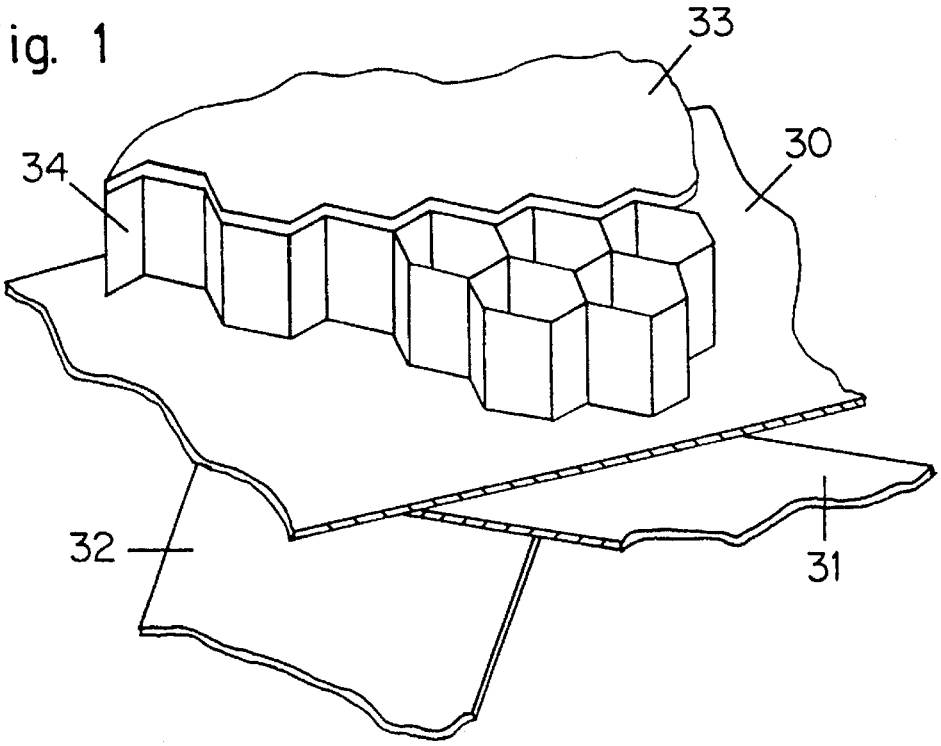
Figure 2:
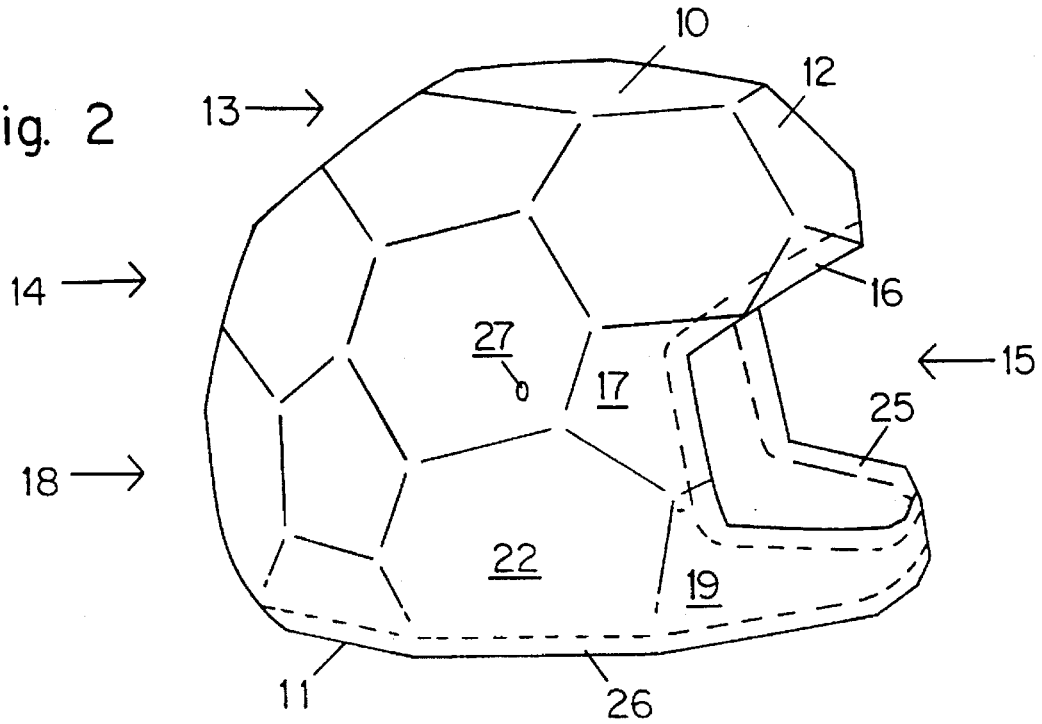

Further features of the invention will be described with reference to an embodiment thereof in the form of a crash helmet, given by way of example and with reference to the drawings, in which:

FIG. 1 is an enlarged partial sectional view of the structure of the helmet; and FIG. 2 is a simplified perspective view of the helmet.

The helmet is made using a mould of the appropriate shape, typically a part of a spheroid. A female (external) mould can be used; such a mould can be of, e.g., 2 pieces, so that the helmet can be removed from it. However, a male (internal) mould (of, eg, 3 pieces, so that it can be removed when the helmet is made) can be used. It is easier to construct the helmet using an internal mould; however, with an external mould, a good finish to the outer surface of the helmet can readily be achieved.

The helmet is constructed in three stages—forming the first shell or membrane, forming the layer of honeycomb material, and forming the second shell or membrane. If the helmet is made using a female mould, the first shell is the outer shell and the second shell is the inner shell. Each shell is formed using resin and impact-resistant cloth such as KEVLAR™ or SPECTRA 900™.

The shells may be formed using spreadable resin and strips of impact-resistant cloth. Convenient resins are epoxy (which is thermosetting) or phenolic resins (e.g. PEI—polyetherimide or PES—polyethersulphone, which are thermoplastic), and convenient impact-resistant materials are DYNEMA™, KEVLAR™, and carbon fibres.

Layers of resin are spread, with strips of cloth being pressed into each layer, using sufficient layers to give an adequate strength. An alternative procedure for making the shells is to use strips of impact-resistant cloth pre-impregnated with resin. Around 3 layers for each shell have been found to be convenient, with successive layers being laid in different directions, to give good general strength and flexibility, since such strips are generally stronger in the weft than in the warp direction. The directions may for example be at steps of 45° for 3 layers, or 90° for 2, to give close to isotropic strength and stiffness. It is desirable for the outer shell to be thicker than the inner shell; convenient thicknesses are 1 mm for the outer membrane and 0.5 mm for the inner.

The layers of cloth for the first shell are laid and pressed into position manually, but their conformance to the inside of the mould is preferably assisted by evacuating the space outside the mould (the mould having suitable porosity) and/or inserting into the mould a balloon which is inflated to press the layers against the inside of the mould.

Once the first shell has bean formed, a layer of honeycomb material is inserted in it. A suitable material is NOMEX™ aramid material formed as a network of hexagonal cells, with a thickness of some 5–6 min. Such honeycomb materials are normally highly flexible, and a sheet of suitable size may be used without cutting, by pushing it gradually into the first shell in the mould. (This will of course result in the cells being denser towards the bottom (neck) part of the helmet.) The honeycomb material can be pressed into position by a balloon as described above.

The inner shell is then formed inside the honeycomb layer, in substantially the same way as the outer shell was formed.

The shells are then cured, to set the resin, by heating to a suitable temperature for a suitable time. This curing may be performed separately for the two shells, but can be performed as a final stage after the full structure of three layers has been formed.

The honeycomb layer should adhere to the two shells which it separates; this can conveniently be achieved by using resins and a honeycomb material which will adhere together, selecting a honeycomb material with a suitable surface coating if necessary. This adhesion may be developed during the curing process.

FIG. 1 shows diagrammatically the resulting layered structure. One shell layer is shown as formed of strips of impact-resistance material 30, 31, and 32 laid one over the other in different directions; the other shell 33 is shown complete; and the two shells are separated by a honeycomb layer.

Any helmet has a downward opening, so that it can be lowered onto the user's head. The mould is obviously made in the shape of the helmet, with a downward opening corresponding to the downward opening of the-helmet. This allows the various layers or shells of the helmet structure to be inserted into the mould during the laying up of the helmet.

Crash helmets normally extend down around the user's head so that the head is almost completely enclosed, and therefore also normally have a visor opening to allow the user to see out. For the present crash helmet, the mould is preferably made to match the intended shape of the helmet without a visor opening, ie consisting of a spheroid with only the base opening which allows the entry of the user's head. The helmet is therefore laid up in the mould as a spheroid with only the base opening which allows the entry of the user's head. The visor opening is then cut out after the shell structure has been formed, either before or after curing. Edgings are then added around the edges of both the head opening and the visor opening, and glued in position to give a finished appearance and protect the exposed edges of the honeycomb material.

Hinges or other mountings will also, of course, be attached at suitabe points so that a transparent visor can be mounted on the helmet.

The helmet may also be provided with an inner support or lining of webbing or other resilient material. The primary function of this inner lining is to give a comfortable fit to the user's head, though it will also provide a further cushioning and spreading effect on any sharp blow to the shell.

The helmet can of course be painted as desired; it is of course desirable to choose a resin which is not affected by the paint.

Crash helmets normally have a smoothly curved spheroidal form, and such a form may be used for the present helmet. Alternatively, however, the helmet may, have a somewhat polyhedral form over at least part of its surface. More specifically, the preferred polyhedral form is based on a truncated icosahedron. (This is approximately the usual pattern of present day footballs, referred to in the United States as soccer balls, though soccer balls have the polyhedral faces curved to give a close approximation to a sphere.

FIG. 2 shows this preferred polyhedral form. The top polygon 10 of the helmet is a hexagon, which is horizontal and approximately parallel to the bottom edge 11 of the helmet. A pentagon 12 forms the foremost polygon, sloping down from the top polygon 10; this polygon forms one of a ring 13 of six polygons, alternately pentagons and hexagons, around the top polygon 10.

In a true truncated icosahedron, the ring 13 would be followed by a ring 14 of nine polygons, consisting of three, pairs of hexagons separated by three individual pentagons. In the present helmet, approximately a third of this ring is missing, to form the viewing aperture 15. More precisely, the two front hexagons are almost completely missing, with only triangular portions 16 remaining, and the two front pentagons 17 adjacent to them have relatively small portions removed.

In a true truncated icosahedron, the ring 14 would be followed by a second ring 18 also of nine polygons, like the ring 14 but oppositely oriented. In the present helmet, this ring is cut off at its lower edge to form the bottom edge 11 of the helmet. More precisely, both the pentagons and the hexagons are slightly truncated, with the hexagons having removed from them triangular portions slightly larger than the portions 16 remaining of the front two hexagons of the ring 13.

In addition, the shape of this ring 18 departs substantially from the true truncated icosahedron at the front of the helmet. The front pentagon of this ring in a true truncated icosahedron is entirely missing, and instead, the two hexagons 19 adjacent to it are curved to merge in a smooth curve around the lower front of the helmet.

It will be realized that the meeting lines of the various polygons are in fact slightly rounded, rather than sharp as shown; also, the vertexes of where the polygons meet are rounded, as indicated. Further, some or all of the polygons themselves, such as those around the bottom edge 11 of the helmet, are slightly curved; in particular, the polygons 22 are curved to slightly spread the outline of the bottom edge 11 into a relatively smoothly curved surface.

A helmet of this shape is constructed using a mould of corresponding shape. After the helmet has been shaped, its edges are preferably finished by fitting strips of U-shaped material, as shown at 25 and 26 and piercing a pair of holes 27 as shown for a transparent visor to be hinged to the helmet.

It will be realized that with the polyhedral form of the helmet, the shape can be based on any suitable polyhedron, ie any shape which is a reasonable approximation to a sphere.

The polyhedral shape of a helmet so constructed, and the material of such a helmet, both provide an improved resilience and impact resistance to both sharp and blunt objects. The flat sections of the polyhedral shape allow localized plate deformation and bending to occur with acceptable design deformation limits, and the composite construction contains external deformations of the helmet within the shell structure without them penetrating through.

With the present construction the outer membrane serves to transmit and spread the load of any impact to the honeycomb. The inner membrane provides a relatively rigid support for the honeycomb, which acts as the main energy absorbing and dissipating element. The outer membrane is preferably thicker than the inner membrane (eg 3 plies for the outer membrane and 2 for the inner), as the outer membrane has to withstand greater localized loads than the inner membrane. Compared with a conventional helmet the present construction can achieve a 30% weight saving in combination with a 35% improvement in energy absorption of some 150 J on the first impact and some 110 J on the second impact (tested to the Snell SA90 specification).

For applications other than crash helmets, the various parameters may need to be changed appropriately. Thus for ballistic protection, the shells may be constructed of a DYNEMA™/glass hybrid composite using around 12 plies in all. This yields a shell weight of around 5 kg $m^{-2}$; the shell has a penetration resistance of V50, measured using 0.22 calibre 170 gr fragment at some 700 m $s^{-1}$.

I claim:

1. A safety helmet comprising an outer shell formed as a sandwich, comprising outer and inner composite layers each of resin and impact-resistant material separated by an intermediate layer of resilient material, the shell having a polyhedral form including plural polygonal faces having abutting edges.

2. A safety helmet according to claim 1 wherein the polygonal faces are shaped as pentagons and hexagons forming part of a truncated icosahedron.

3. A safety helmet according to claim 1 wherein the impact-resistant material includes a high tensile strength fiber cloth.

4. A safety helmet according to claim 3 wherein the fiber includes one of KEVLAR™, DYNEMA™, glass fiber and carbon fiber.

5. A safety helmet according to claim 1 wherein the resilient material includes honeycomb material.

6. A safety helmet according to claim 1 wherein the resilient material includes one of paper, aluminum, cork, foamed plastic and other resilient plastics material.

7. A safety helmet comprising an outer shell formed of impact-resistant material, the outer shell having a generally polyhedral form including plural polygonal faces having abutting edges, each of a plurality of said faces having plural non-intersecting edges abutting an edge of another of said faces.

8. A safety helmet according to claim 7 wherein the outer shell is formed as a sandwich having outer and inner composite layers each of resin and impact-resistant material separated by an intermediate layer of resilient material, the outer composite layer having the generally polyhedral form.

9. A safety helmet according to claim 8 wherein the polyhedral form includes plural rings extending horizontally completely around the shell, each ring consisting of plural polygonal faces having abutting edges.

10. A safety helmet according to claim 9 wherein the polyhedral form includes an upper substantially horizontal surface formed of a single polyhedron having edges abutting edges of polyhedrons of one of said rings.

11. A safety helmet according to claim 10 wherein a second ring includes polyhedrons having edges abutting edges of the polyhedrons of the first ring.

12. A safety helmet according to claim 8 wherein the polyhedral form includes plural rings extending horizontally completely around the shell, each ring consisting of plural polygonal faces having abutting edges, the polyhedrons of adjacent pairs of said rings having abutting edges.

13. A safety helmet according to claim 7 wherein the polyhedral form includes plural rings extending horizontally completely around the shell, each ring consisting of plural polygonal faces having abutting edges.

14. A safety helmet according to claim 13 wherein the polyhedral form includes an upper substantially horizontal surface formed of a single polyhedron having edges abutting edges of polyhedrons of one of said rings.

15. A safety helmet according to claim 7 wherein the polyhedral form includes plural rings extending horizontally completely around the shell, each ring consisting of plural polygonal faces having abutting edges, the polyhedrons of adjacent pairs of said rings having abutting edges.

16. A safety helmet according to claim 7 wherein the polyhedrons include pentagons and hexagons having abutting edges.

17. A safety helmet comprising an outer shell 3 formed of impact-resistant material, the outer shell having a generally polyhedral form including plural polygonal flat adjacent faces of plates arranged so the plates deform and bend in response to an impact to transmit and spread forces of the impact.

* * * * *